US007668331B2

(12) United States Patent
Yen

(10) Patent No.: US 7,668,331 B2
(45) Date of Patent: Feb. 23, 2010

(54) FIDELITY SPEAKER

(76) Inventor: Wailit Yen, 35-A Hilary Court, 63-G Bonham Rd., Mid-Level, Hong Kong (HK)

( * ) Notice: Subject to any disclaimer, the term of this patent is extended or adjusted under 35 U.S.C. 154(b) by 733 days.

(21) Appl. No.: 11/246,460

(22) Filed: Oct. 7, 2005

(65) Prior Publication Data

US 2007/0081680 A1 Apr. 12, 2007

(51) Int. Cl.

| | |
|---|---|
| ***H04R 1/20*** | (2006.01) |
| *H04R 25/00* | (2006.01) |
| *H04R 1/02* | (2006.01) |
| *H04R 9/06* | (2006.01) |

(52) U.S. Cl. ..... 381/349; 381/160; 381/182; 381/186; 381/335; 381/340; 381/346; 381/347; 381/370; 381/387

(58) Field of Classification Search ..... 381/182, 381/186, 349

See application file for complete search history.

(56) References Cited

U.S. PATENT DOCUMENTS 4,805,221 A * 2/1989 Quaas ..... 381/335
4,882,760 A * 11/1989 Yee ..... 381/335
5,388,162 A * 2/1995 Sohn ..... 381/160
5,815,589 A * 9/1998 Wainwright et al. ..... 381/346
5,995,634 A * 11/1999 Zwolski ..... 381/160
2005/0207606 A1* 9/2005 Yang ..... 381/370

FOREIGN PATENT DOCUMENTS

JP 02260899 A * 10/1990 ..... 381/186

* cited by examiner

*Primary Examiner*—Brian Ensey
*Assistant Examiner*—Matthew Eason
(74) *Attorney, Agent, or Firm*—Tope-McKay & Associates; Marcus L. Risso

(57) ABSTRACT

An improved-fidelity speaker system is presented. The sound system includes a frame and a pair of matching speakers. The frame is formed to hold a first speaker and a second speaker, each having a front side, a back side, and central axis. When attached with the frame, the two speakers are substantially aligned along their central axes in a configuration selected from a group consisting of being mounted in the frame such that the front sides of the speakers are facing away from each other, and being mounted in the frame such that the front sides of the speakers are facing towards each other. When the speakers are operated in unison, a sound wave is generated and pushed outward from the frame and approximately radially from the central axes of the speakers in up to 360 degrees, expanding outward about a plane approximately perpendicular to the central axes.

16 Claims, 10 Drawing Sheets

FIDELITY SPEAKER

FIELD OF INVENTION

The present invention relates to a sound system and, more particularly, to a frame and speaker system that includes two opposing speakers that are aligned on a central axes to generate a sound wave that is pushed outward from the frame and approximately radially from the central axes of the speakers in up to 360 degrees, expanding outward about a plane approximately perpendicular to the central axes.

BACKGROUND OF INVENTION

Sound systems utilizing speakers have long been used in the art to generate audio signals. Speakers take electrical signals and convert them into physical vibrations to create sound waves. FIG. 1 illustrates a traditional speaker system 100 of the prior art. As shown in FIG. 1, the traditional speaker system 100 includes a speaker 102 attached with some sort of a frame 104. Upon receiving an electrical signal, the speaker 102 pushes a lump of air (i.e., creating a sound wave 105) that is forced away from the speaker 102 to be received by a user 106 who interprets the sound wave as sound.

By virtue of their configurations, sound waves generated by the prior art are limited to a maximum 180 degree projection 108 from the frame 104. A result of such a configuration is that another user 110 positioned behind the projection 108 of the speaker 102 does not receive a direct sound wave 105. Although sound waves often bounce off of objects and reach the other user 110 in some form, they are distorted and do not provide for optimum sound quality.

Thus, a continuing need exists for a sound system that generates a sound wave that is projected 360 degrees from the frame, providing all users with a direct sound wave.

SUMMARY OF INVENTION

The present invention relates to an improved-fidelity speaker system. The sound system comprises a frame formed to hold a first speaker having a front side, back side, and central axis and a second speaker having a front side, back side, and central axis. The two speakers are substantially aligned along their central axes in a configuration selected from a group consisting of being reverse-mounted in the frame such that each of the respective front sides of the speakers are facing away from each other, and being mounted in the frame such that each of the respective front sides of the speakers are facing towards each other. When the speakers are attached with the frame and the speakers are operated in unison, a sound wave is generated and pushed outward from the frame and approximately radially from the central axes of the speakers in up to 360 degrees, expanding outward about a plane approximately perpendicular to the central axes.

The frame further includes a first baffle portion for holding the first speaker; and a second baffle portion for holding the second speaker. The second baffle portion is connected with, and positioned proximate and substantially parallel to, the first baffle portion. When the first and second speakers are attached with the first and second baffle portions, respectively, the first and second speakers are positioned opposite each other.

In another aspect, the sound system further comprises a first speaker and a second speaker connected with the frame. The speakers are matched. Each of the first and second speakers are connected with the frame in a configuration selected from a group consisting of being reverse-mounted in the frame such that each of their respective back sides are facing each other, and being mounted in the frame such that each of their respective front sides are facing each other.

In yet another aspect, the present invention further comprises a first container connected with the first baffle portion, such that first container in conjunction with the first baffle portion forms a first enclosure for holding a first speaker. The first enclosure is formed in a shape selected from a group consisting of being box-shaped and tube-shaped.

In another aspect, the present invention further comprises a second container connected with the second baffle portion, such that the second container in conjunction with the second baffle portion forms a second enclosure for holding a second speaker. The second enclosure is formed in a shape selected from a group consisting of being box-shaped and tube-shaped.

In another aspect, the first and second speakers are reverse-mounted in the frame such that each of their respective back sides are facing each other, and wherein the first and second speakers are wired out-of-phase.

In another aspect, the frame is formed such that a gap having a width exists between each of the back sides of the first and second speakers.

Additionally, the first and second speakers are mounted in the frame such that each of their respective front sides are facing each other, and wherein the first and second speakers are wired in-phase.

Furthermore, the frame is formed such that a gap having a width exists between each of the front sides of the first and second speakers.

In yet another aspect, the present invention further comprises an adjuster to adjust the gap's width.

In another aspect, the first and second speakers are mounted in the frame such that each of their respective front sides are facing each other with the first and second speakers wired in-phase, and wherein the frame further comprises an ear attachment such that the sound system is formed to operate as a headphone with the sound waves generated by the speakers being forced toward a user's ear if using the sound system.

Additionally, the ear attachment is a cushioned ring for placing against a user's ear.

In another aspect, the present invention further comprises a baffle material connected with the frame such that the baffle material is positioned opposite the ear attachment and directs sound waves toward the ear attachment.

In another aspect, the sound system comprises a frame having two sealed containers and a pressure chamber formed between the two sealed containers, where the pressure chamber is open to an exterior of the frame; and an array of speakers connected with each of the sealed containers, such that when the array of speakers are operated, air is squeezed in and out of the pressure chamber.

Additionally, each speaker in the array of speakers has a front side and a back side, and wherein each speaker is connected with its respective container such that its front side faces the pressure chamber.

Furthermore, each speaker in the array of speakers has a front side and a back side, and wherein each speaker is connected with its respective container such that its back side is positioned within the pressure chamber.

Finally, the present invention also includes a method for forming an improved-fidelity speaker system. The method comprises an act of forming a frame to hold a first speaker having a front side, back side, and central axis and a second speaker having a front side, back side, and central axis such that the two speakers are substantially aligned along their central axes in a configuration selected from a group consisting of being reverse-mounted in the frame such that each of the respective front sides of the speakers are facing away from each other, and being mounted in the frame such that each of the respective front sides of the speakers are facing towards each other, wherein when the speakers are attached with the frame and the speakers are operated in unison, a sound wave is generated and pushed outward from the frame and approximately radially from the central axes of the speakers in up to 360 degrees, expanding outward about a plane approximately perpendicular to the central axes

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
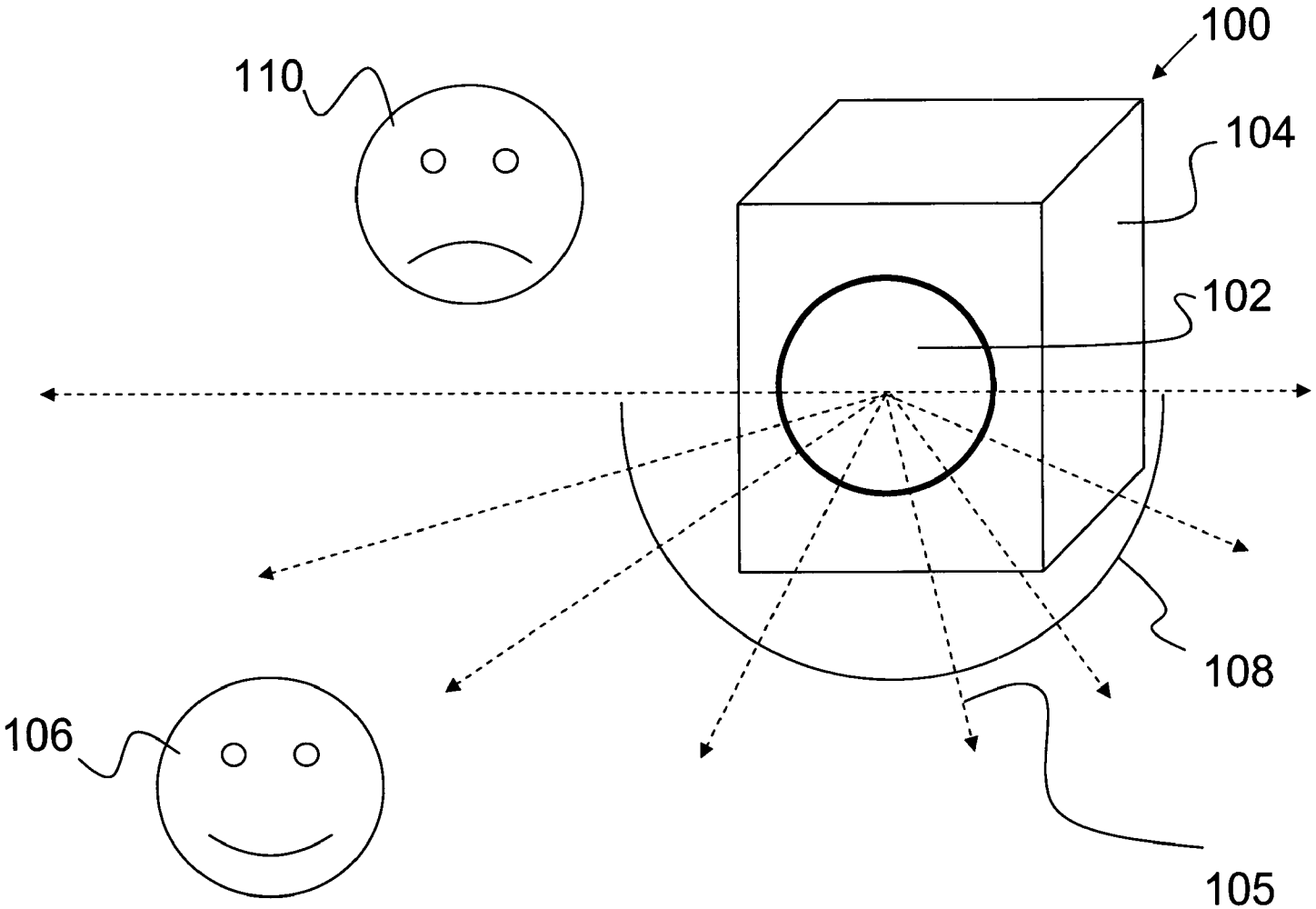
FIG. 1 is an illustration of a traditional speaker system of the prior art.

The present invention relates to a sound system and, more particularly, to a frame and speaker system that includes two opposing speakers that are aligned on a central axes to generate a sound wave that is pushed outward from the frame and approximately radially from the central axes of the speakers in up to 360 degrees, expanding outward about a plane approximately perpendicular to the central axes. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, first an introduction is provided to provide the reader with a general understanding of the present invention. Next, a description of various aspects of the present invention is provided to give an understanding of the specific details.

(1) Introduction

Speaker systems of the prior art generate sound waves that are projected out from the speakers. A problem with traditional systems, however, is that the sound waves are projected directly out from a front of the speaker, leaving individuals positioned behind the speaker to receive deflected and distorted sound waves. As an improvement upon the prior art, the present invention includes two opposing speakers that are positioned within a frame such that any individual situated around the speaker system is provided with a direct sound wave.

(2) Description of Various Aspects

Figure 2:
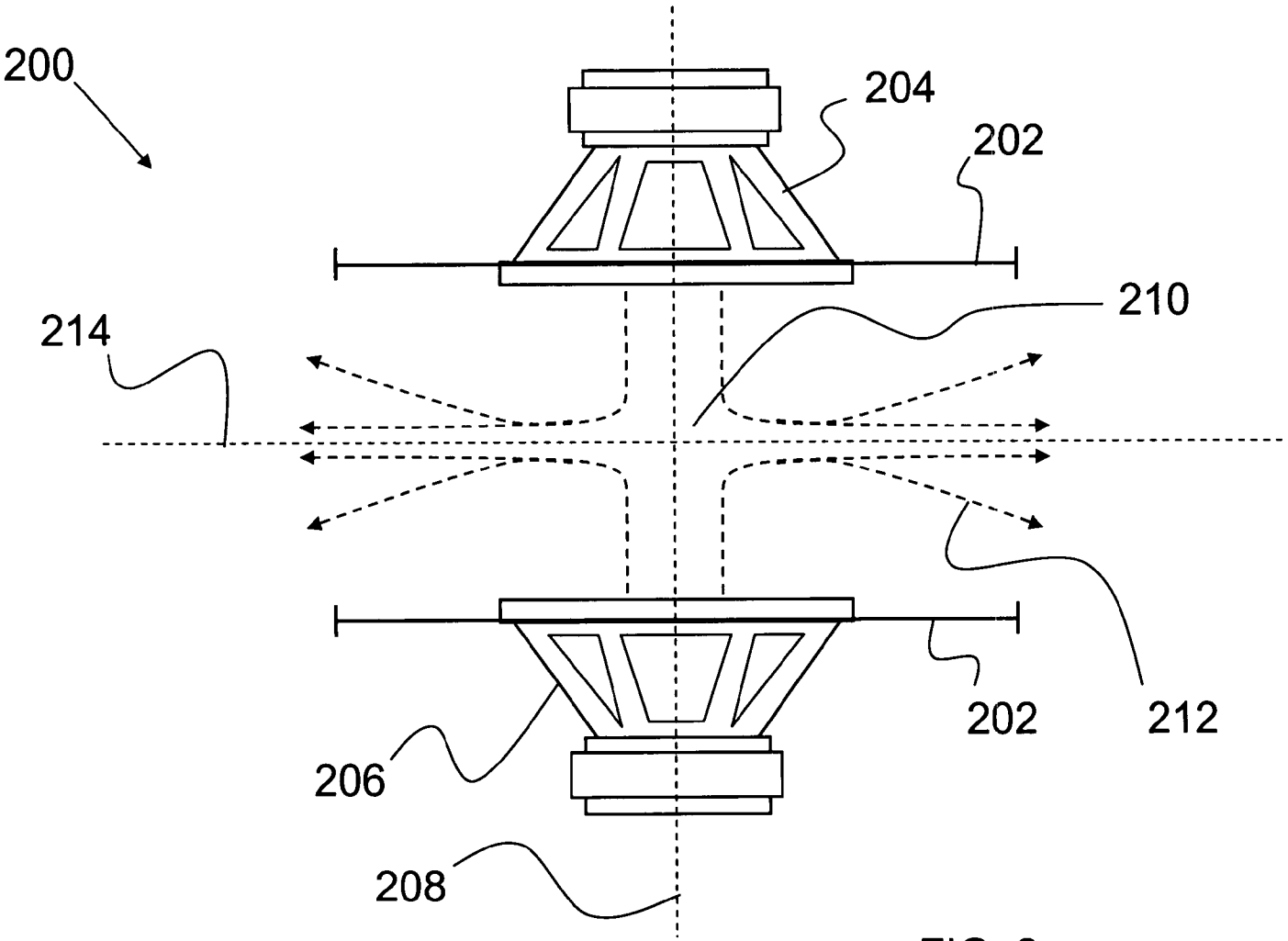
FIG. 2 is a side-view illustration of a sound system according to the present invention.

The present invention relates to an improved-fidelity speaker system. As shown by FIG. 2, the sound system 200 includes a frame 202 that is formed to hold a first speaker 204 and a second speaker 206, where each of the speakers 204 and 206 have a central axis 208. The frame 202 is formed such that when the speakers 204 and 206 are attached with the frame, the speakers 204 and 206 reside opposite each other and are substantially aligned along their central axes 208. Through such a configuration, when the speakers 204 and 206 are operated in unison, a high-pressure area 210 is formed in the center between the two speakers 204 and 206. Sound waves 212 are then generated that are pushed outward to the low-pressure area from the frame 202 and approximately radially from the central axes 208 of the speakers 204 and 206 in up to 360 degrees. The sound waves 212 expand outward about a plane 214 that is approximately perpendicular to the central axes 208. As can be appreciated by one skilled in the art, the sound waves 212 depicted in FIG. 2 are for general illustrative purposes only as actual sound waves are more complex and do not necessarily travel in such ordered configurations.

As shown in FIG. 2, the speakers 204 and 206 are stacked vertically such that the plane 214 is approximately horizontal. Such a configuration provides for optimal sound projection in 360 degrees. Although the sound system 200 is depicted as having vertically stacked speakers 204 and 206, one skilled in the art can appreciate that the invention is not intended to be limited thereto. In other aspects, the speakers 204 and 206 can be positioned horizontally or at an angle, so long as their central axes 208 are approximately aligned to form sound waves 212 that are pushed outward from the frame 202 as described.

Figure 3:
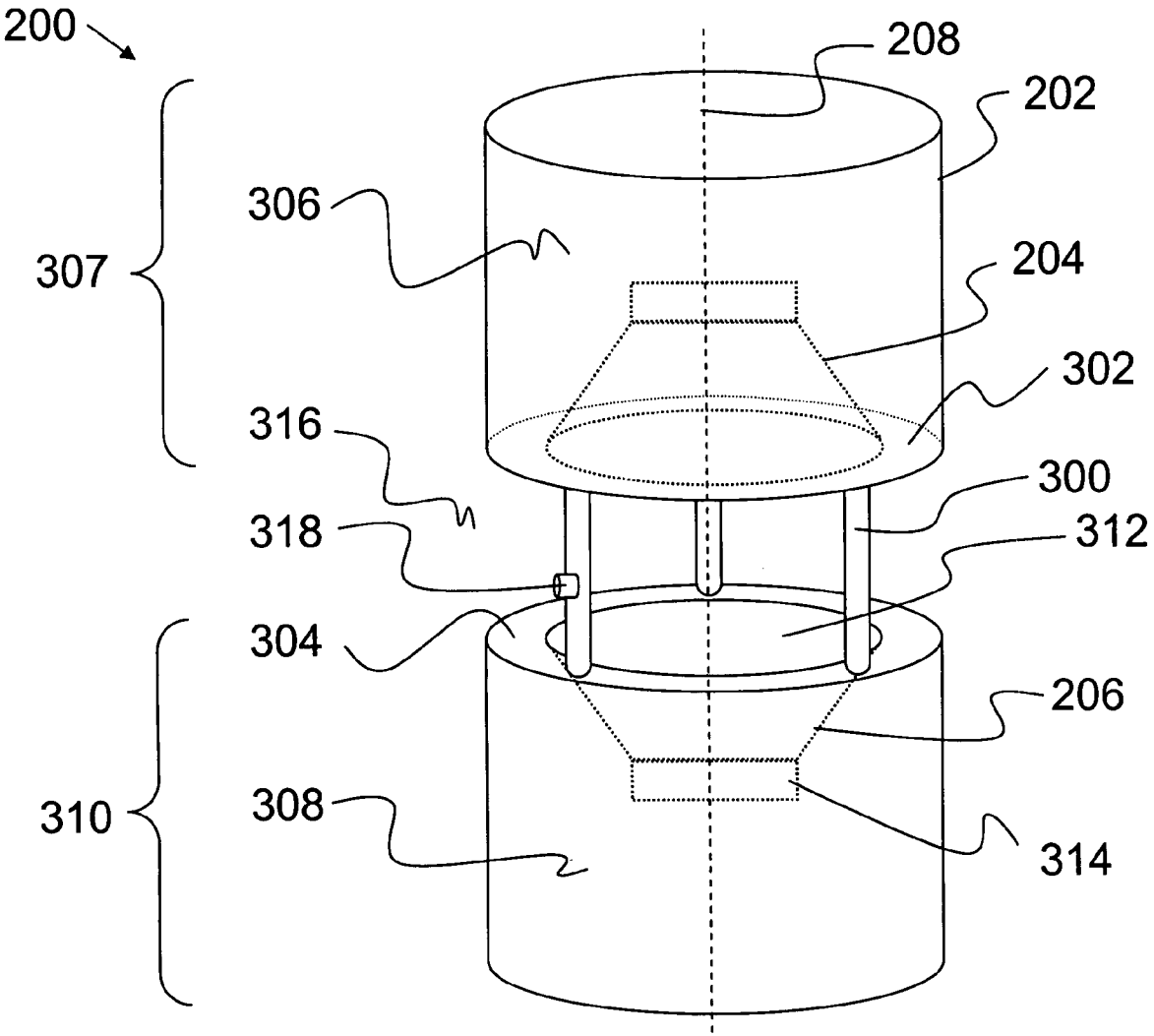
FIG. 3 is a perspective-view illustration of a sound system according to the present invention.

FIG. 3 illustrates the sound system 200 with a frame connector 300 to hold the two speakers 204 and 206 apart. As shown, the frame 202 includes a first baffle portion 302 for holding the first speaker 204 and a second baffle portion 304 for holding the second speaker 206. The baffle portions 302 and 304 are connected such that they are positioned proximate and substantially parallel to the each other, thereby positioning the speakers 204 and 206 opposite each other and aligning the central axes 208. The length of the baffle is about a quarter or a half of the lowest cross-over or cut-off wavelength.

Depending upon the particular speakers and desired acoustic characteristics, enclosures often provide speakers with an increase in performance. Thus, the sound system 200 can also be formed to include enclosures for each of the speakers 204 and 206. For example, a first container 306 is connected with the first baffle portion 302 to form a first enclosure 307 to hold the first speaker 204. Additionally, a second container 308 is connected with the second baffle portion 304 to form a second enclosure 310 for holding the second speaker 206.

The enclosures 307 and 310 can be formed in any suitable shape to accommodate a wide range of speakers and designs, non-limiting examples of which include being box-shaped and tube-shaped.

In addition to the frame 202, the sound system also includes the first and second speakers 204 and 206. The speakers 204 and 206 are any suitable speakers that generate a sound wave, non-limiting examples of which include low-range, mid-range, high-range, and full range speakers. It is important to note that the speakers 204 and 206 should be matched so that there is minimal interference and/or cancellation of sound waves. In matching the speakers 204 and 206, it is desirable that they are similar within 20% of their specifications, and it is most desirable that they are within 10% of the specifications.

Although the present invention is illustrated as having a single speaker pair with enclosures, the invention is not intended to be limited thereto. As can be appreciated by one skilled in the art, a plurality of speaker pairs can be used in accordance with the present invention. Additionally, one can envision a frame 200 where the first and second enclosures 307 and 310 are interconnected to form a single enclosure.

Each of the speakers 204 and 206 has a front side 312 and a back side 314. The speakers 204 are connected with the frame 202 such that they are opposite each other in both space and configuration. For example, as shown in FIG. 3, the speakers 204 and 206 are mounted in the frame such that each of their respective front sides 312 are facing each other. The front side 312 generally represents the cone or dome portion of a speaker, whatever the particular case may be. When the Front sides 312 of the speakers 204 and 206 are facing each other, the speakers 204 and 206 are wired in-phase. Additionally, the frame 202 is formed such that the speakers 204 and 206 include a gap 316 between each of their respective front sides 312.

The frame 202 is formed such that the width of the gap 316 provides optimal performance for a particular speaker pair. As the sound system 200 is formed with different speakers having different specifications, one skilled in the art can appreciate that the gap 316 may need to be changed to accommodate different speakers.

In another aspect, an adjuster 318 can be included that adjusts the width of the gap. The adjuster 318 is any mechanism or device that can be used to adjust the distance between two objects, non-limiting examples of which include a screw system and a telescopic tube system. Through use of an adjuster 318, a user can tune the sound system 200 for optimal performance.

Figure 4:
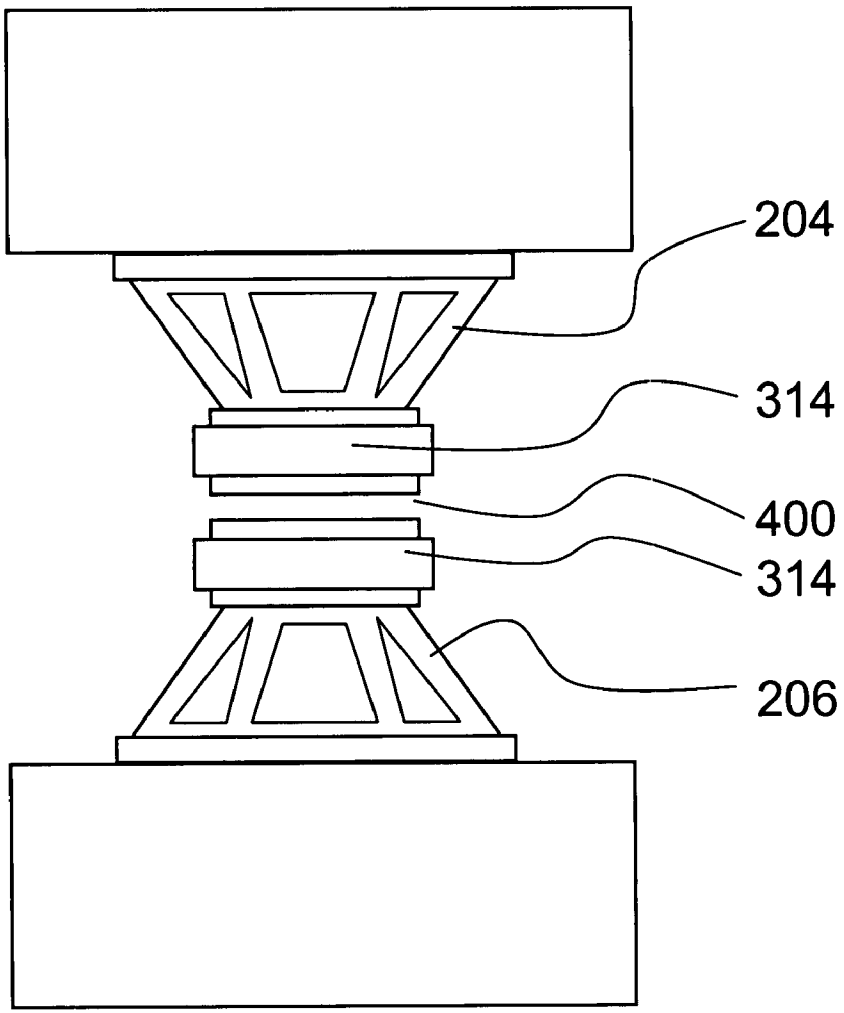
FIG. 4 is a side-view illustration of a sound system according to the present invention.

Alternatively, as show in FIG. 4, the speakers 204 and 206 can be reverse-mounted with the frame 202. In this aspect, each of their respective back sides 314 are facing each other. When reverse-mounted, the speakers 204 and 206 are wired out-of-phase. Additionally, the frame 202 is formed such that a gap 400 exists between each of the back sides 314. Although the gap 400 is not necessary for operation, it reduces vibration noise and interference that could occur should the back sides 314 be touching.

Should it be desirable to form the frame 202 such that the back sides 314 are touching, a connector (e.g., adhesive) can be used to connect the back sides 314 to reduce vibrations. In a broad sense, the back sides 314 generally comprise the driver portions (i.e., electromagnet) of the speakers 204 and 206. In another aspect, the speakers 204 and 206 can be formed to share a single driver portion.

Figure 5:
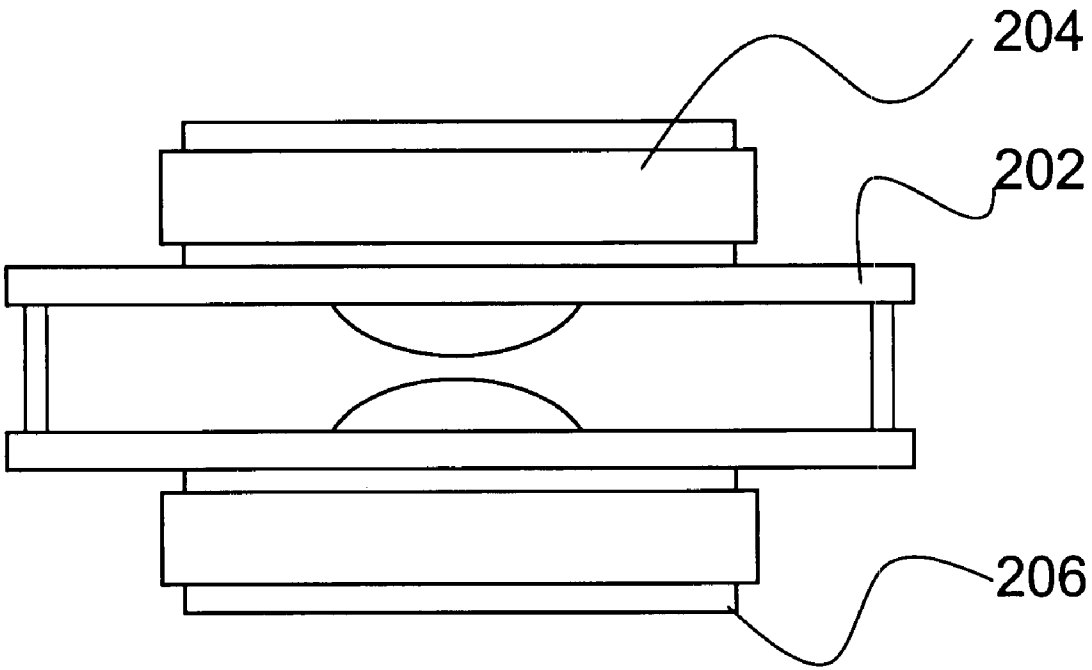
FIG. 5 is a side-view illustration of a sound system according to the present invention.

Different speaker types operate optimally with different frame 202 configurations. As such, the frame 202 can be formed to accommodate the various forms of speakers. As a non-limiting example, and as shown in FIG. 5, the speakers 204 and 206 can be tweeters. Tweeters operate with or without an enclosure. As such, the frame 202 in this aspect is simply formed to hold the first and second speakers 204 and 206 opposite each other.

Figure 6:
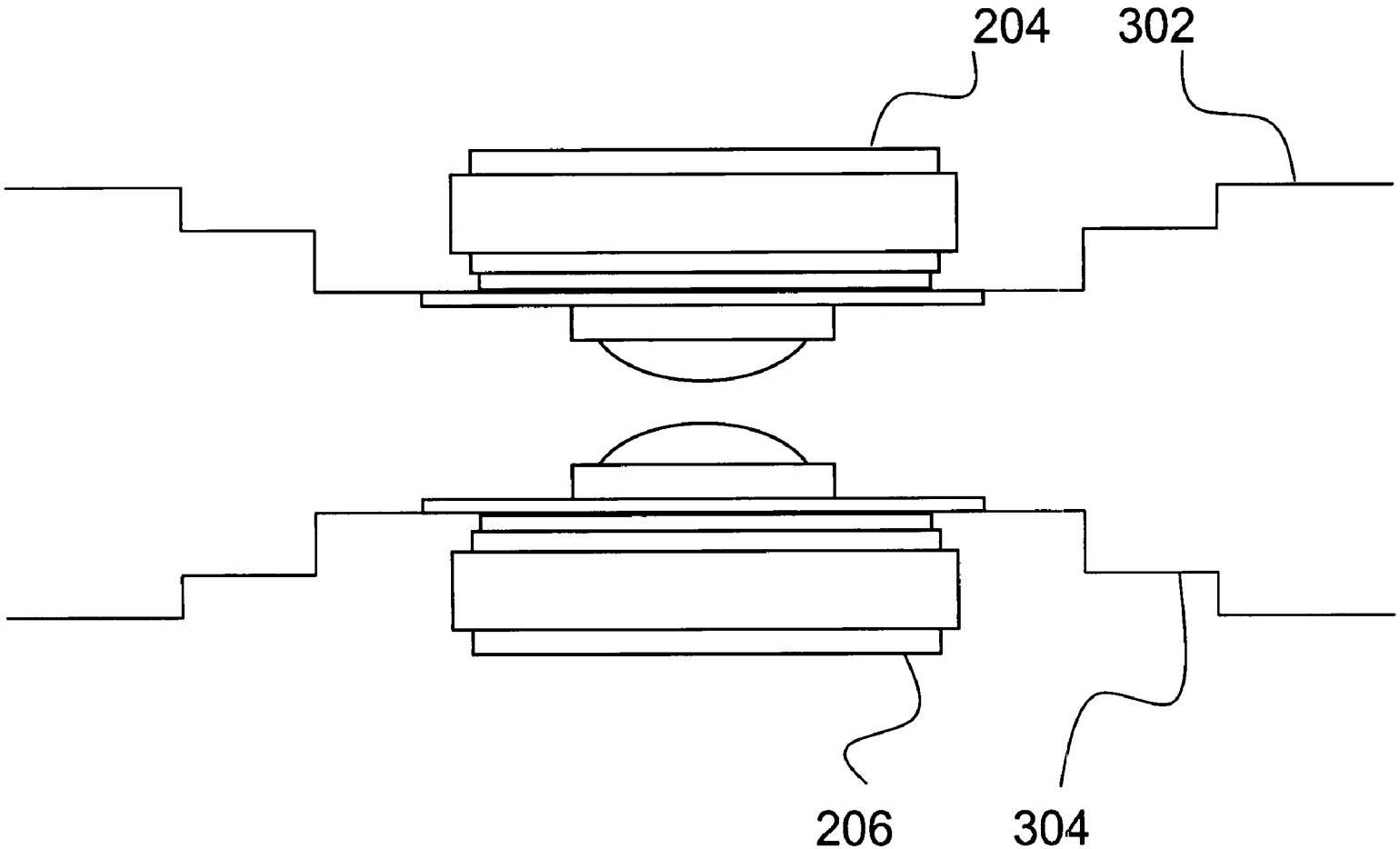
FIG. 6 is a side-view illustration of a sound system according to the present invention.

As another example, and as shown in FIG. 6, the first and second baffle portions 302 and 304 may be used to hold the speakers 204 and 206 opposite each other with or without an enclosure (as described above). The baffle portions 302 and 304 are formed in any suitable shape to hold the speakers 204 and 206. The baffle portions 302 and 304 can be flat (as depicted in FIG. 3), or stepped as depicted in FIG. 6.

Figure 7:
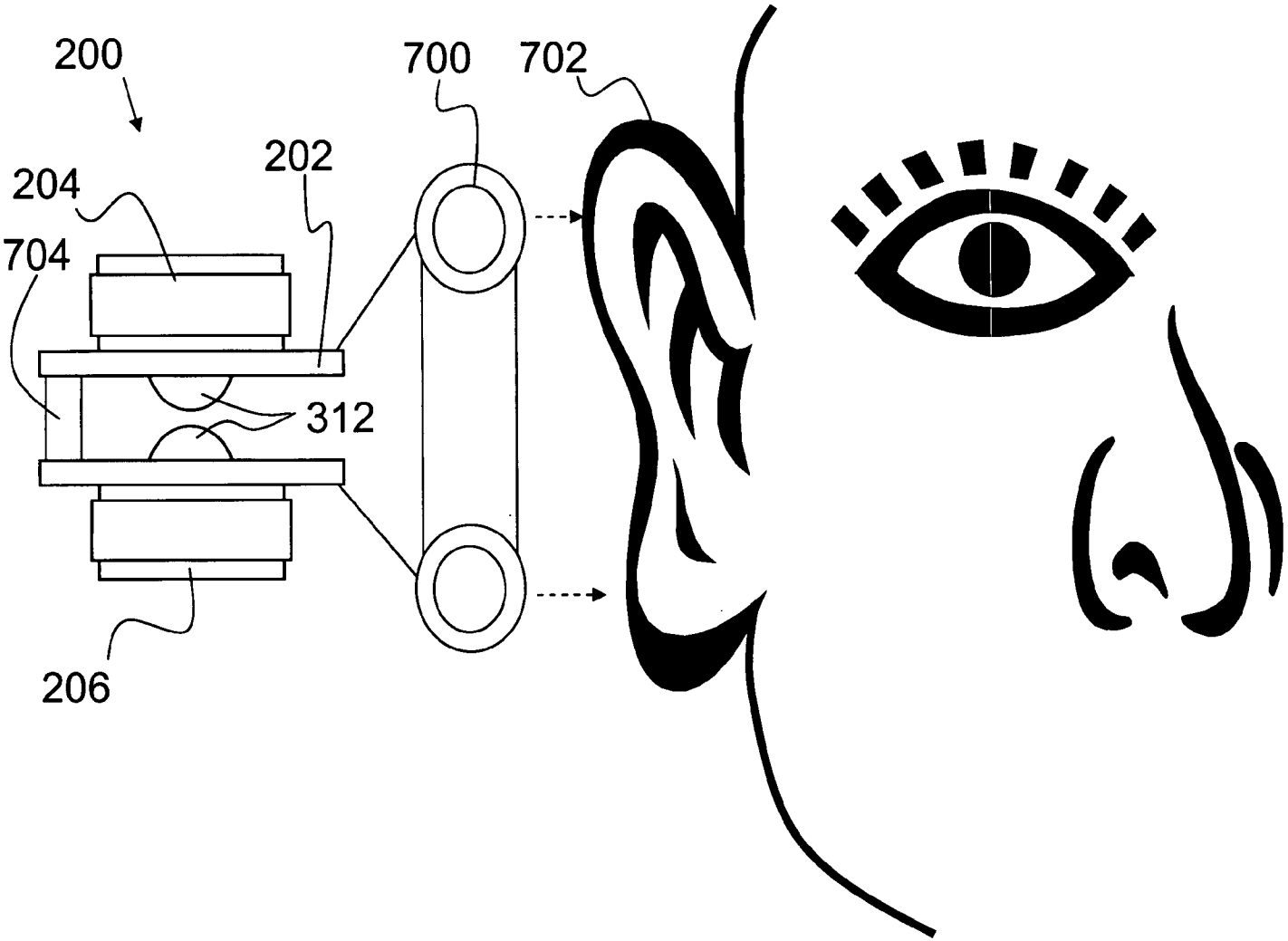
FIG. 7 is a cross-sectional illustration of a sound system according to the present invention, where the sound system is incorporated into a headphone.

In another aspect, as shown in FIG. 7, the frame 202 includes an ear attachment 700 such that the sound system 200 is formed to operate as a headphone with the sound waves generated by the speakers 204 and 206 being forced toward the ear attachment 700. In this aspect, the first and second speakers 204 and 206 are mounted in the frame 202 such that each of their respective front sides 312 are facing each other with the first and second speakers 204 and 206 wired in-phase. The ear attachment 700 is any suitable mechanism or device for connecting with a user's ear 702, a non-limiting example of which includes being a cushioned ring for placing against a user's ear 702. A damping material 704 is connected with the frame 202 such that it is positioned opposite the ear attachment 700 and directs sound waves toward the ear attachment 700. The damping material 704 is any suitable mechanism or device that operates as a baffle, non-limiting examples of which include foam, plastic, and insulation. As can be appreciated by one skilled in the art, a second sound system 200 can be included to be connected with a user's second ear to form a full headphone set.

Figure 8:
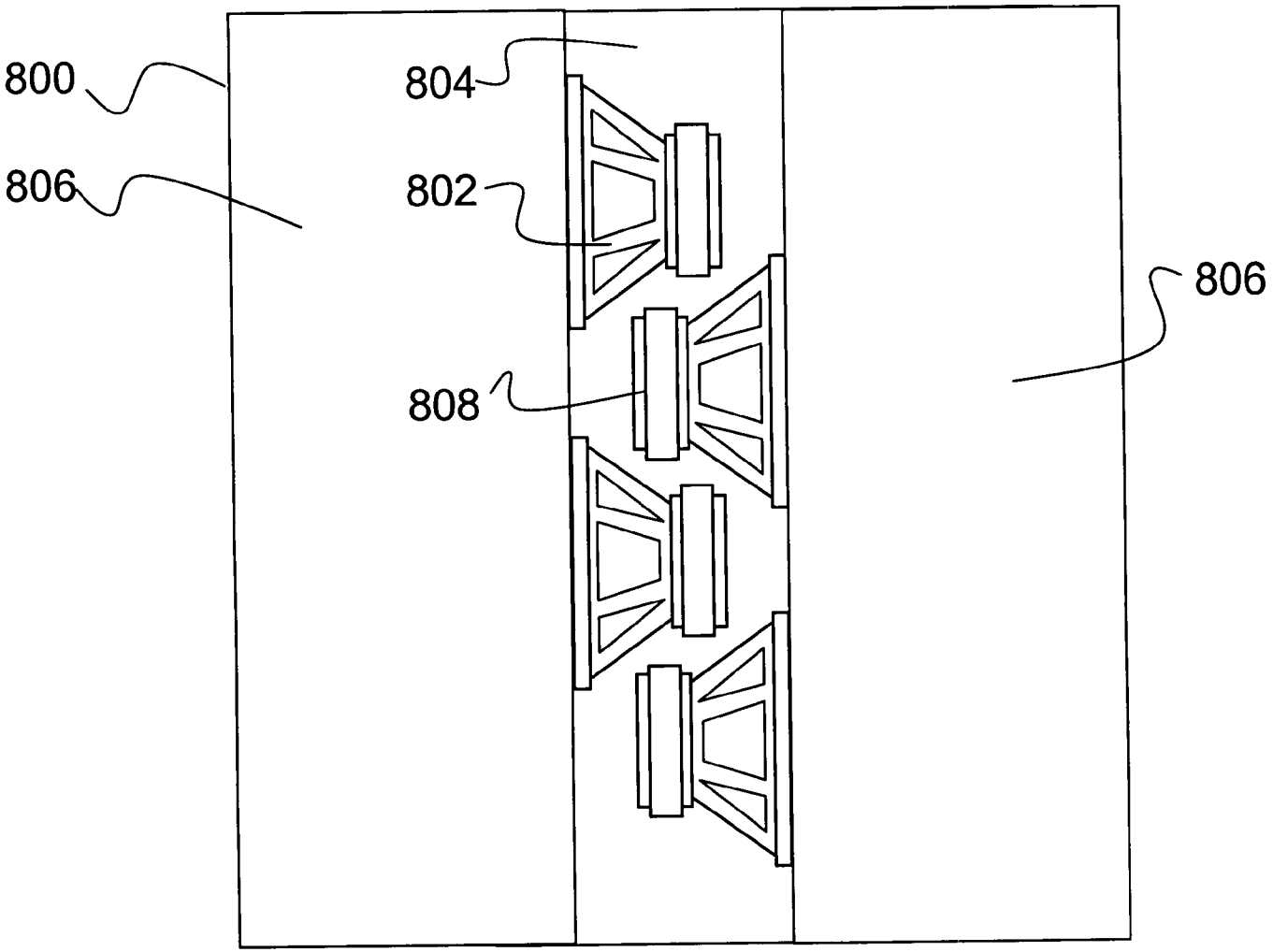
FIG. 8 is side-view illustration of another aspect of a sound system of according to the present invention.
Figure 9:
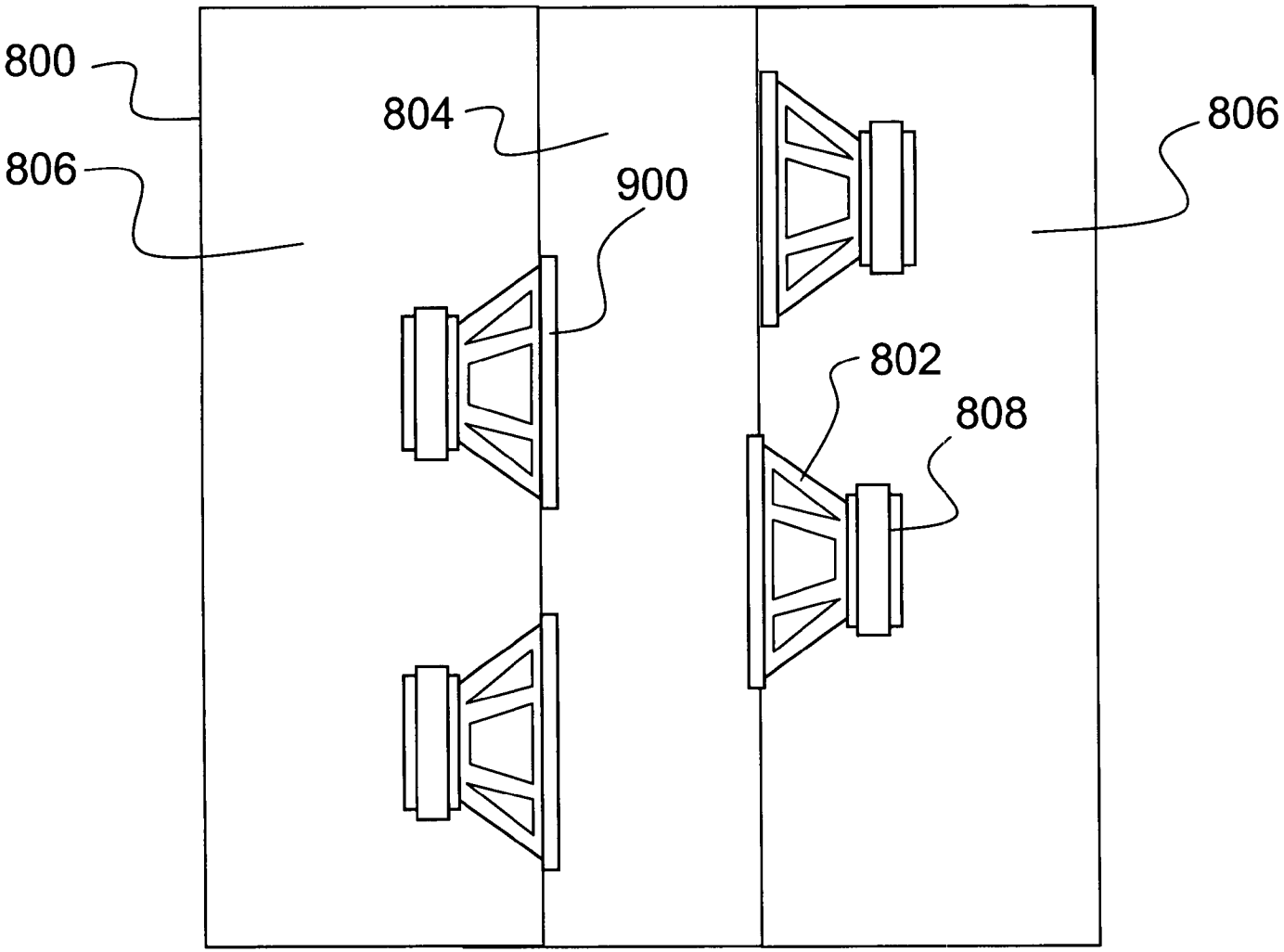
FIG. 9 is an interior-view illustration of another aspect of a sound system according to the present invention.

FIGS. 8 and 9 illustrate an interior of another aspect of the present invention. As shown in FIGS. 8 and 9, a frame 800 is formed to hold an array of speakers 802. In this aspect, a pressure chamber 804 is formed between two sealed containers 806, where each of the two containers 806 includes speakers 802 attached thereto. The pressure chamber 804 is ported so that the speakers 802 squeeze air in and out of the pressure chamber 804. As shown in FIG. 8, the speakers 802 can be attached with the two containers 806 such that their back sides 808 are positioned within the pressure chamber. Alternatively, and as shown in FIG. 9, the speakers can be attached with the two containers 806 such that their front sides 900 are positioned toward the pressure chamber 804 with their back sides 808 positioned within each of the respective containers 806.

Figure 10:
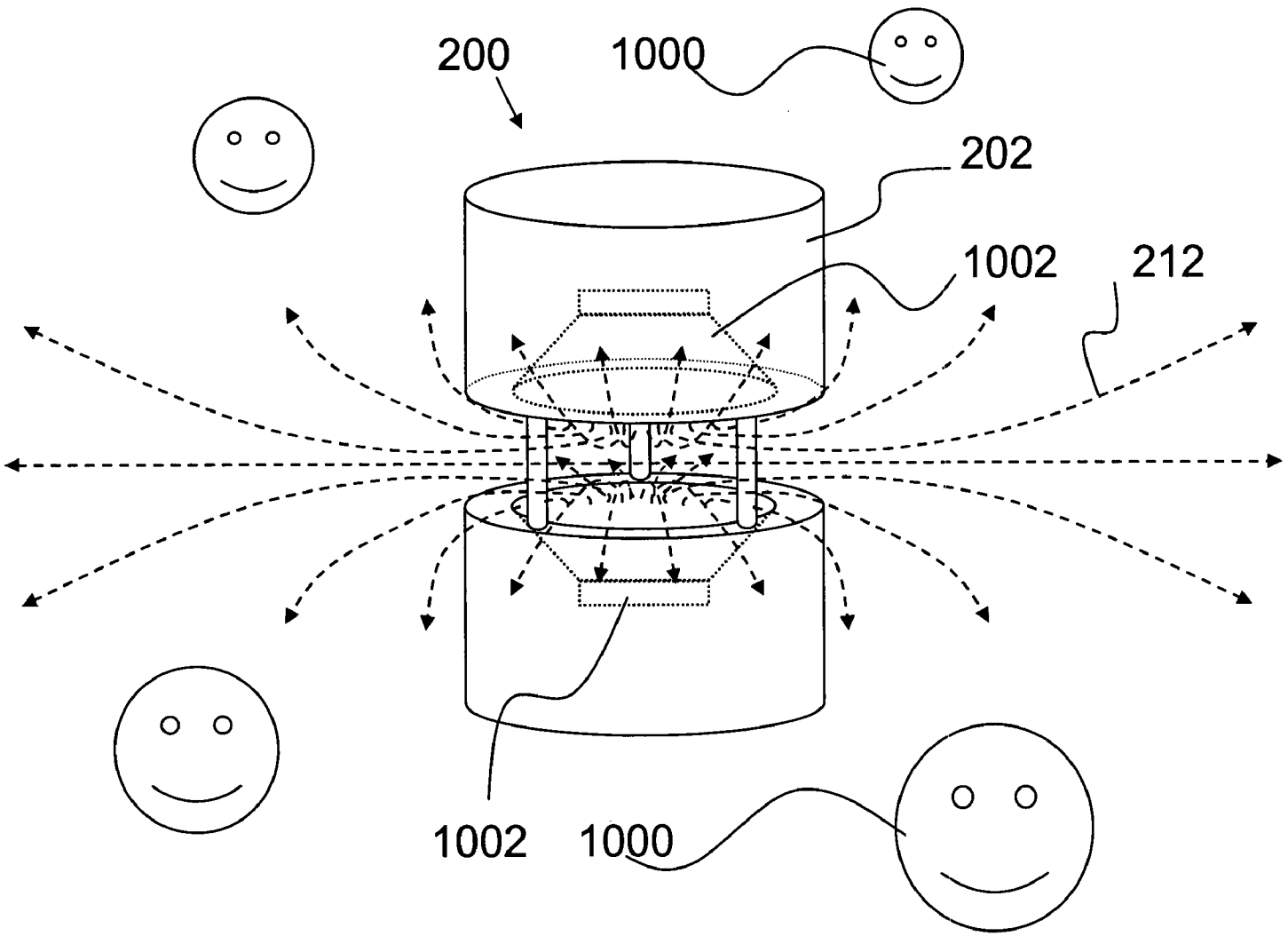
FIG. 10 is an illustration of the sound system according to the present invention.

In summary and as illustrated in FIG. 10, the present invention is a sound system 200 that provides users 1000 positioned 360 degrees around the sound system 200 with direct sound waves 212 (with the exception of the headphone aspect and the array aspect described in FIGS. 7 through 9). The frame 202 holds a pair of matched speakers 1002 opposite each other such that they can be operated in unison to generate and push sound waves 212 outward from the frame 202 and approximately radially from the central axes of the speakers.

In a conventional speaker, a large speaker cone is needed to move a large volume of air. However, by using the compound sound system 200 of the present invention, the same amount of air movement can be achieved by using two smaller and lighter speakers (instead of one). An advantage of using a lighter and smaller speaker is that it will allow a user to use two smaller magnets to drive each speaker and voice coil, making the speaker cheaper and easier to fabricate.

Additionally, the mechanism of generating sound waves by the sound system 200 at its center and then being pushed out differs from the conventional speaker where the sound wave is being pushed in its forward direction perpendicular to its cone. Because of this difference, the sound wave from the sound system 200 is evenly dispersed at the 360 degree plane, and it can be distinctly recognized closer to the original sound than a conventional speaker. Furthermore, in a conventional speaker system, the sound pressure level decreases as the frequency increases. This is because the conventional speaker moves only in one direction. Therefore, any individual away from the center of the speaker will experience a decrease of sound level which is easily measured by a sound level meter. By way of example, this sound level difference can vary from 0 decibels at the center of the speaker to −10 decibels at 60 degrees off the center at 10 kilohertz. Such a limitation does not apply to the sound system 200 of the present invention because the sound wave is generated evenly about the speaker over a 360 degree angle (arc).

What is claimed is:

1. A 360 degree compound sound system, comprising:

a frame;

a first baffle portion connected with the frame, and wherein a first container is connected with the first baffle portion such that the first container in conjunction with the first baffle portion forms a first enclosure for holding a first speaker;

a second baffle portion connected with the frame, the second baffle portion connected with the frame such that it is positioned proximate and substantially parallel to the first baffle portion, and wherein a second container is connected with the second baffle portion such that the second container in conjunction with the second baffle portion forms a second enclosure for holding a second speaker;

a first speaker mounted to the first baffle, the first speaker having a front side, a back side, and a central axis, with the first speaker being reverse-mounted with the first baffle such that the front side of the first speaker faces the first enclosure;

a second speaker mounted to the second baffle, the second speaker having a front side, a back side, and a central axis, with the second speaker being-reverse mounted with the second baffle such that the front side of the second speaker faces the second enclosure;

wherein the first and second speakers are mounted such that they are substantially aligned along their central axes and such that each of their respective back sides face each other;

wherein the speakers are matched; and wherein when the speakers are operated in unison, a sound wave is generated and pushed outward from the frame and approximately radially from the central axes of the speakers in up to 360 degrees, expanding outward about a plane approximately perpendicular to the central axes.

2. A 360 degree compound sound system as set forth in claim 1, wherein the first enclosure is formed in a shape selected from a group consisting of being box-shaped and tube-shaped.

3. A 360 degree compound sound system as set forth in claim 2, wherein the second enclosure is formed in a shape selected from a group consisting of being box-shaped and tube-shaped.

4. A 360 degree compound sound system as set forth in claim 3, wherein the first and second speakers are wired out-of-phase.

5. A 360 degree compound sound system as set forth in claim 4, wherein the frame is formed such that a gap having a width exists between each of the back sides of the first and second speakers.

6. A 360 degree compound sound system as set forth in claim 5, further comprising an adjuster to adjust the gap's width.

7. A 360 degree compound sound system as set forth in claim 1, wherein the first and second speakers are wired in-phase, and wherein the frame further comprises an ear attachment such that the sound system is formed to operate as a headphone with the sound waves generated by the speakers being forced toward a user's ear if using the sound system.

8. A 360 degree compound sound system as set forth in claim 7, wherein the ear attachment is a cushioned ring for placing against a user's ear.

9. A 360 degree compound sound system as set forth in claim 8, further comprising baffle material connected with the frame such that the baffle material is positioned opposite the ear attachment and directs sound waves toward the ear attachment.

10. A 360 degree compound sound system as set forth in claim 1, wherein the second enclosure is formed in a shape selected from a group consisting of being box-shaped and tube-shaped.

11. A 360 degree compound sound system as set forth in claim 1, wherein the first and second speakers are wired out-of-phase.

12. A 360 degree compound sound system as set forth in claim 1, wherein the frame is formed such that a gap having a width exists between each of the back sides of the first and second speakers.

13. A 360 degree compound sound system as set forth in claim 12, further comprising an adjuster to adjust the gap's width.

14. A 360 degree compound sound system as set forth in claim 1 wherein the first and second speakers are wired in-phase.

15. A sound system for generating sound waves, comprising:

a frame having two sealed containers, a first enclosure and a second enclosure, and a pressure chamber formed between the first enclosure and the second enclosure, where the pressure chamber is open to an exterior of the frame;

an array of speakers connected with each of the first and second enclosures, such that when the array of speakers are operated, air is squeezed in and out of the pressure chamber;

wherein each speaker in the array of speakers has a front side and a back side;

wherein at least two speakers are connected with the first enclosure such that their front sides are directed toward the first enclosure while their back sides are positioned within the pressure chamber; and wherein at least two additional speakers are connected with the second enclosure such that their front sides are directed toward the second enclosure while their back sides are positioned within the pressure chamber.

16. A 360 degree compound sound system, comprising:

a frame formed to hold a first speaker having a front side, back side, and central axis and a second speaker having a front side, back side, and central axis such that the two speakers are substantially aligned along their central axes, wherein when the speakers are attached with the frame and the speakers are operated in unison, a sound wave is generated and pushed outward from the frame and approximately radially from the central axes of the speakers in up to 360 degrees, expanding outward about a plane approximately perpendicular to the central axes;

wherein the frame further includes:

a first baffle portion for holding the first speaker; and a second baffle portion for holding the second speaker, the second baffle portion connected with, and positioned proximate and substantially parallel to, the first baffle portion, whereby when the first and second speakers are attached with the first and second baffle portions, respectively, the first and second speakers are positioned opposite each other;

further comprising a first container connected with the first baffle portion, such that first container in conjunction with the first baffle portion forms a first enclosure for holding a first speaker;

further comprising a second container connected with the second baffle portion, such that the second container in conjunction with the second baffle portion forms a second enclosure for holding a second speaker;

further comprising a first speaker and a second speaker connected with the first and second enclosures, respectively, where the speakers are matched, and where each of the first and second speakers are connected with the enclosures in a reverse-mounted configuration such that each of their respective back sides are facing each other while their front sides are facing the first and second enclosures, respectively;

wherein the first enclosure is formed in a shape selected from a group consisting of being box-shaped and tube-shaped; and wherein the second enclosure is formed in a shape selected from a group consisting of being box-shaped and tube-shaped.

* * * * *